United States Patent [19]

Zahn

[11] Patent Number: 4,527,290

[45] Date of Patent: Jul. 9, 1985

[54] INTERNAL STRUCTURE FOR A PROTECTIVE HELMET

[75] Inventor: Christian Zahn, Brunswick, Fed. Rep. of Germany

[73] Assignee: Schuberth-Werk GmbH & Co. KG, Brunswick, Fed. Rep. of Germany

[21] Appl. No.: 475,101

[22] Filed: Mar. 14, 1983

[30] Foreign Application Priority Data

Mar. 13, 1982 [DE] Fed. Rep. of Germany ..... 3209192

[51] Int. Cl.[3] ..... A42B 3/00

[52] U.S. Cl. ..... 2/416

[58] Field of Search ..... 2/416, 419, 417, 418, 2/420, 411, 425, 410

[56] References Cited

U.S. PATENT DOCUMENTS

| | | | |
|---|---|---|---|
| 2,994,087 | 8/1961 | Trice | 2/419 |
| 3,020,551 | 2/1962 | Austin | 2/419 |
| 3,054,111 | 9/1962 | Hornickel et al. | 2/416 |
| 3,852,822 | 12/1974 | Watkins et al. | 2/417 |

*Primary Examiner*—Peter Nerbun

*Attorney, Agent, or Firm*—Michael J. Striker

[57] ABSTRACT

An inner structure of a protective helmet secured to a helmet shell comprises a head bearing ring, a plurality of belt straps forming a spider and each having an end secured to the helmet shell and a plurality of fasteners each corresponding to the respective belt strap and formed of plastics. Each fastener has a shackle-shaped portion connected to the end of the respective belt strap. The head bearing ring is formed of plastics. Each fastener is connected to the head bearing ring by a hinge joint and formed integrally therewith such that the fastener is pivoted relative to the head bearing ring.

12 Claims, 8 Drawing Figures

(A-A)

A
A
1
2
3
3a
4
4a
4b
5
6
7
8
9
10

INTERNAL STRUCTURE FOR A PROTECTIVE HELMET

BACKGROUND OF THE INVENTION

The present invention relates to protective helmets in general and, more particularly to an internal portion of the protective helmet, which is secured to the shell of the helmet.

Internal portions or structures for protective helmets usually comprise a plurality of belt bands or straps forming a spider, the ends of the belt straps being fastened to the shell of the helmet by means of fasteners. Conventional internal constructions of protective helmets include plug-in fasteners each being formed as an individual shackle which has been loosely connected at its one end to the cross-piece of the head bearing ring of the helmet and at its another end it has been provided with a plug stem of an enlarged cross-section. The plug stem, or foot has been inserted from below into a respective pocket formed in the helmet shell; this plug stem formed a force transmission portion from the helmet shell to the belt spider. Knobs have been provided on the front edge of the U-shaped plug stem, which knobs have been engaged in special stamp-outs formed in the belt straps.

In these known internal structures the fasteners have been made from relatively hard synthetic plastic material whereas the head bearing ring has been formed of soft plastics so that it can be easily adjusted to the head of a user.

The manufacture of these conventional internal structures is rather expensive because the head bearing ring itself as well as the plug locks or fasteners must be produced by at least four individual injection molding processes. The assembly of the individual components of the internal structure is also expensive because all the plug fasteners must be individually connected to the head bearing ring.

A further disadvantage of conventional internal structures is a fastening means utilized for securing the belt straps to the stems of the fasteners. In the case of high loads exerted on the belts a pulling force transmitted from the belt strap to the expanded stem of the fastener will push the latter from the pocket of the helmet shell. This will result in the transmission of the pulling force to the projections formed on the edge of the stem positioned in the pocket of the helmet shell.

SUMMARY OF THE INVENTION

It is an object of the invention to provide an improved internal structure for a protective helmet.

It is a further object of the invention to provide an internal structure of the protective helmet which is easy to manufacture and easy to use.

These and other objects of the invention are attained by an inner structure of a protective helmet secured to a helmet shell, comprising a plurality of belt straps forming a spider and each having an end secured to the helmet shell; a plurality of plug-in fasteners each corresponding to the respective belt strap and formed of plastics, each of said fasteners having a shackle-shaped portion connected to the end of the respective belt strap; and a head bearing ring formed of plastics and connected to the fasteners, each plug-in fastener being connected to the head bearing ring by a hinge joint and being formed integrally therewith so that the fastener is pivoted relative to the head bearing ring to be positioned against the latter.

In the internal structure according to the invention all the plug-in fasteners are formed integrally with the head bearing ring and from the same plastics material and can be therefore produced in a single injection molding process. The structure requires a plane formation of the plastics elements whereby an individual hinge joint is provided for each plug fastener so that in assembly all the fasteners can be pivoted to be positioned against the head bearing ring.

A further advantage of the internal structure for the protective helmet according to the invention resides in that when the fastener hangs on the end of the belt strap it is fixed in a predetermined position by locking elements.

The head bearing ring may include a plurality of cross-pieces each corresponding to the respective fastener so that the respective fastener is connected to the respective cross-piece by the hinge joint.

The shackle-shaped portion of each fastener may be formed with openings and each cross-piece is formed with pins which are engaged in the respective openings when the fastener lies against the head bearing ring.

Each hinge joint may be formed between the respective cross-piece and the fastener so that the two locking positions of the respective fastener in the direction lengthwise of the belt strap can be obtained. Therefore, the position of the head bearing ring with respect to the helmet shell can varied which is also advantageous. In the event of the use of the belt straps of the constant length the active length of belt straps relative to the head bearing ring can be extended or shortened by the adjustment of the fasteners to two locking positions.

The pins may be arranged in pairs spaced apart from each other.

Each hinge joint may be formed by a weakened portion extended between the respective cross-piece and the plug fastener.

Two weakened portions may be provided between the respective cross-piece and the fastener, the weakened portions being spaced from each other and extending parallel to each other to form a double hinge joint. These weakened portions can be produced in the same injection molding process. Such an arrangement makes possible a relative displacement of the folded plug fasteners relative to the cross-pieces of the head bearing ring.

Each hinge joint can be also formed by longitudinal locking bars or pieces spaced from each other so as to permit the aforementioned relative displacement.

The internal structure according to the invention may include fastening means for connecting the respective fastener to the end of the respective belt strap.

The fastening means may comprise at least two projections formed on each fastener, the belt straps each being formed with stamp-outs adapted to receive said projections.

The shackle-shaped portion of each fastener may be formed with a stem, said projections being formed on a surface of the stem which faces towards the head bearing ring in the position in which the fastener lies against the head bearing ring.

The fastening means may further include at least one projection formed on the overhung edge of the stem of each fastener, said belt straps being each formed with an additional stamp-out, the end of the respective belt strap being wound about the stem of the respective fastener and said one projection being engaged in the additional stamp-out.

In a modified embodiment of the invention the fastening means may further include a locking bar formed on the stem of each fastener and provided with two openings, said locking bar being pivotable with respect to said stem so that said two projections are engaged in said two openings, respectively and the end of the respective belt strap wound about the stem is clamped between said locking bar and said stem. The locking bar may be formed integrally with the fastener.

In both the embodiments of the fastening means the end portion of the belt strap wound about the stem of the fastener is rigidly clamped in the pocket of the helmet shell and even when loaded remains in that pocket and can not be pulled out from that pocket.

In order to further improve the seat of the stem of the fastener in the pocket of the helmet shell it is advisable that the width of the pocket of the helmet shell would correspond to the thickness of the stem of the fastener plus two thicknesses of the belt strap.

Slots may be provided in the helmet shell for passing therethrough the projections of the stem located in the pocket of the helmet shell in the assembly.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
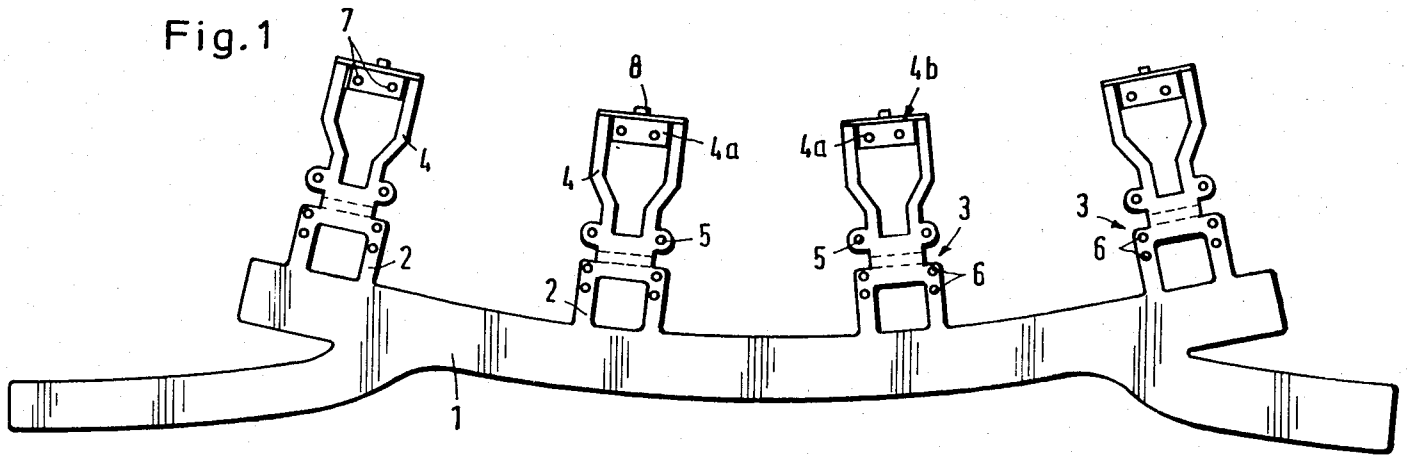
FIG. 1 is a side view of a head bearing ring-like strip of the internal structure of the helmet according to the invention.

Referring now to the drawings, and first to FIG. 1 it will be seen that an internal structure for a protective helmet includes a head bearing ring-like strip 1 which is normally attached to the head of a user. The circular strip 1 which is illustrated in a flat position includes four cross-pieces 2 on each of which a plug-in fastener 4 is hingedly supported by means of a respective hinge joint 3.

Figures 2, 3, 4, 5, 6:
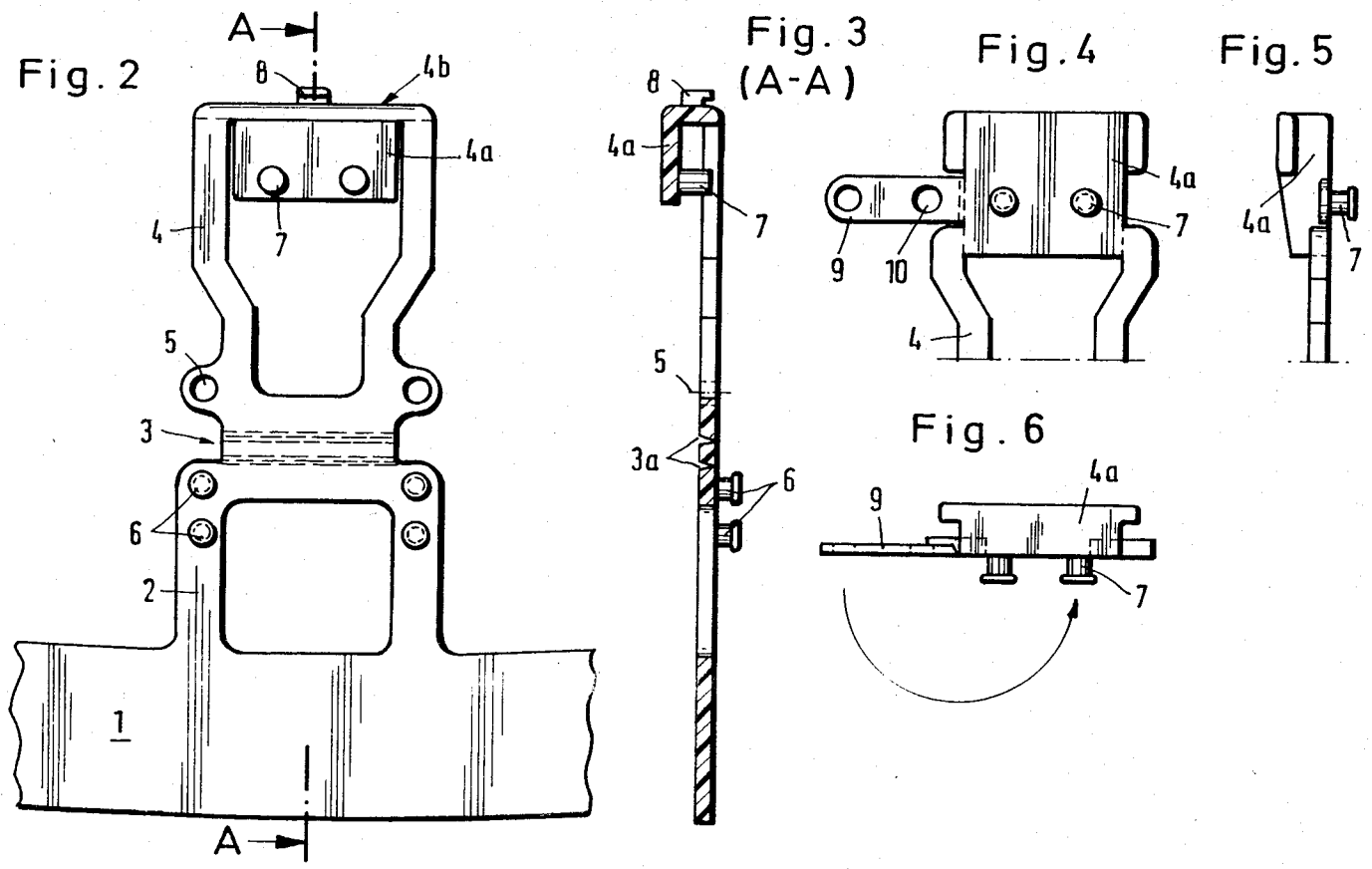
FIG. 2 is a partial view of the ring-like strip with a shackle of FIG. 1 on the enlarged scale.
FIG. 3 is a sectional view on line III—III of FIG. 2.
FIG. 4 is a partial view of the shackle of the head strip according to a modified embodiment of the invention.
FIG. 5 is a side view of FIG. 4.
FIG. 6 is a top plan view of FIG. 4.

The individual cross-piece 2, hinge joint 3 and plug-in fastener 4 are shown in FIGS. 2 and 3 on the enlarged scale. The hinge joint 3 is formed by two parallel weakened or narrowed portions 3*a* provided between the cross-piece 2 and plug-in fastener 4 and spaced apart from each other so that they altogether form a double hinge joint.

Figure 7:
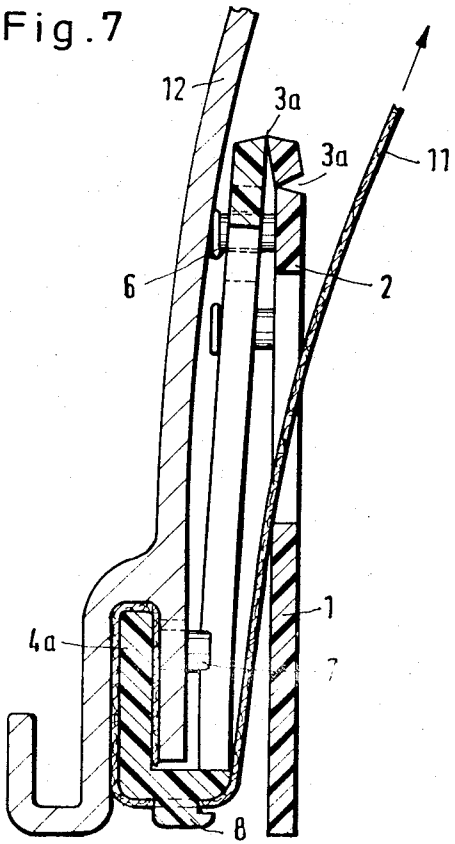
FIG. 7 is a partial view, on the enlarged scale, of the head strip assembled on the helmet shell according to the embodiment of FIGS. 2 and 3.

The plug-in fastener 4 has a shackle-shaped portion 14 and a lower portion 16, the latter being formed with two slots 5 spaced from each other and formed as locking openings which correspond in diameters to pins 6, provided on the cross-piece 2. Pins 6 are arranged in pairs and extend through the same axes as the respective slots 5. The plug-in fastener 4 can thereby hinge about either one of the weakened portions 3*a* such that the fastener 4 is folded and the slots 5 are pressed against respective pins 6 which are engaged in slots 5 and the folded or hinged fastener 4 is fixed in one of two positions depending on the row of pins engaged in the slots 5. Such a hinged position is illustrated in FIG. 7.

Each shackle 14 of the fastener 4 is provided with a plug stem 4*a* which is formed with two knobs or projections 7 which in the assembled position of ring strip 1 face towards the ring strip 1. The shackle portion 14 is further provided at its overhung front edge with a central knob or projection 8 which can be hook-shaped. The assembly of the head strip on the helmet shell will be explained below with reference to FIG. 7.

FIGS. 4 through 6 illustrate a further embodiment of the plug-in fastener 4. In this modification the plug stem 4*a* is provided with a locking bar 9 projected outwardly laterally therefrom and formed integrally therewith. The locking bar 9 which is formed with two slots 10 corresponding to pins 7 is able to pivot as shown by an arrow in FIG. 6 to lie against the front surface of the stem 4*a* such that, upon pressing of both locking openings or slots 10 against pins 7, the bar 9 can be connected to the shackle portion 14.

Figure 8:
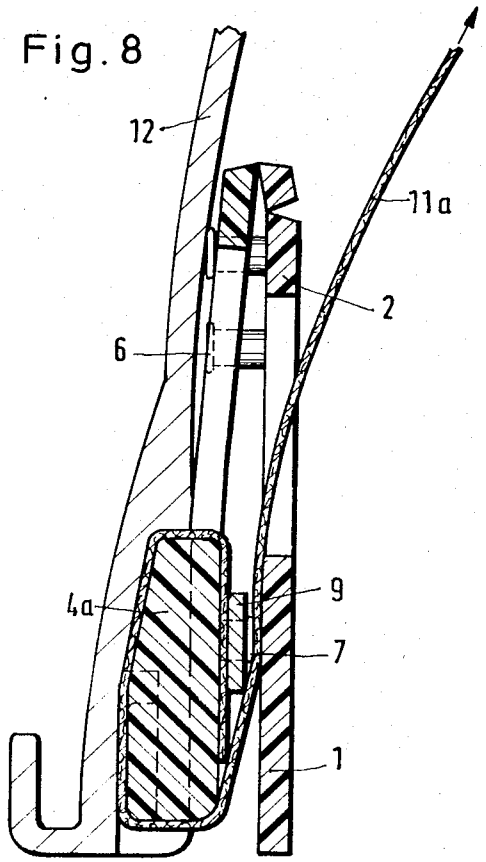
FIG. 8 is a partial view, on the enlarged scale, of the assembled head strip according to the embodiment of FIGS. 4–6.

FIGS. 1–6 illustrate the components of the internal structure of the protective helmet, which also includes a number of belt straps 11 which form a spider. Reference is now made to FIGS. 7 and 8 which show the fastening of the ends of the belt straps 11 to the lower rim of the helmet shell designated as 12.

In the assembly shown in FIG. 7 a head ring-like strip 1 with the fastener of FIGS. 2 and 3 is utilized. The plug-in fastener 4 is hinged against the cross-piece 2 of the head strip 1 and in this position is locked due to the engagement of the pins 6 in the slots 5 which are pressed against the respective pins 6. FIG. 7 shows the first locking position of fastener 4 because two upper pins 6 are engaged in slots 5. The pivoting movement of the plug-in fastener 4 is performed about the upper weakened portion 3*a*. If slots 5 are pressed against the lower pins 6 the hinge movement will take place about the lower weakened portion 3*a*, in the last mentioned locking position will the end of the ring strip 1 lie deeper in the helmet shell.

As shown in FIG. 7 the end of the belt strap 11 is wound about the plug stem 4*a* and the projections 7 and 8 are engaged in respective punch-outs preliminarily formed in the end portion of the belt strap 11. The plug stem 4*a* wrapped by the belt strap 11 is inserted into a pocket or recess 18 of the helmet shell from below. The pocket 18 has a width corresponding to the thickness of the plug stem 4*a* and two thicknesses of the belt strap 11. Grooves 20 are provided in the helmet shell in the region of pocket 18 to receive projections 7 therethrough so that the particularly rigid seats therefor are warranted. The arrow K in FIG. 7 schematically shows the direction of the pulling force exerted on the belt strap 11 during the impact action on the helmet shell 12.

FIG. 8 depicts the assembly of the head strip 1 according to the embodiment of FIGS. 4–6, with the belt strap denoted here as 11*a*. In this embodiment the end of the belt strap is clamped between the surface of the plug stem 4*a* and the locking bar 9 which is in its folded position; both projections 7 thereby are engaged in respective punch-outs or stamp-outs provided in the belt strap.

The ring strip 1 as well as the fasteners 4 are made of synthetic plastic material.

It will be understood that each of the elements described above, or two or more together, may also find a useful application in other types of protective helmets differing from the types described above.

While the invention has been illustrated and described as embodied in an internal structure for a protective helmet, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An inner structure for a protective helmet having a helmet shell, comprising a plurality of belt straps forming a spider and each having an end; a plurality of plug-in fasteners each corresponding to the respective belt strap and formed of plastics, each of said fasteners having a shackle-shaped portion connected to the end of the respective belt strap and adapted to be attached to a helmet shell; a head bearing ring formed of plastics; and a plurality of hinge joints each connecting each plug-in fastener to the head bearing ring so that each fastener is pivoted relative to the head ring to be positioned against the latter, said head bearing ring, said fasteners and said hinge joints together forming a one-piece plastic element.

2. The structure as defined in claim 1, wherein said head bearing ring includes a plurality of cross-pieces each corresponding to the respective fastener so that the respective fastener is connected to the respective cross-piece by the respective hinge joint.

3. An inner structure for a protective helmet having a helmet shell, comprising a plurality of belt straps forming a spider and each having an end; a plurality of plug-in fasteners each corresponding to the respective belt strap and formed of plastics, each of said fasteners having a shackle-shaped portion connected to the end of the respective belt strap and adapted to be attached to a helmet shell; a head bearing ring formed of plastics; and a plurality of hinge joints each connecting each plug-in fastener to the head bearing ring so that each fastener is pivoted relative to the head bearing ring to be positioned against the latter, said head bearing ring including a plurality of cross-pieces each corresponding to the respective fastener so that the respective fastener is connected to the respective cross-piece by the respective hinge joint, said head bearing ring, said fasteners and said hinge joints together forming a one-piece plastic element, the shackle-shaped portion of each fastener being formed with openings and each cross-piece being formed with pins which are engaged in the respective openings when the fastener is positioned against the head bearing ring.

4. The structure as defined in claim 3, wherein each hinge joint is formed between the respective cross-piece and the fastener so that the two locking positions of the respective fastener in the direction lengthwise of the belt strap can be obtained.

5. The structure as defined in claim 4, wherein said pins are arranged in pairs spaced apart from each other.

6. The structure as defined in claim 4, wherein the hinge joint is formed by a weakened portion disposed between respective the cross-piece and the plug-in fastener.

7. The structure as defined in claim 6, wherein two weakened portions are provided between the respective cross-piece and the fastener, said weakened portions being spaced from each other and extending parallel to each other to form a double hinge joint.

8. The structure as defined in claim 4, further including fastening means for connecting the respective fastener to the end of the respective belt strap.

9. The structure as defined in claim 8, wherein said fastening means include at least two projections formed on each fastener, said belt straps each being formed with stamp-outs adapted to receive said projections.

10. The structure as defined in claim 9, wherein said shackle-shaped portion of each fastener is formed with a stem, said projections being formed on a surface of the stem which faces towards the head bearing ring in the position in which the fastener lies against the head bearing ring.

11. The structure as defined in claim 10, wherein said fastening means further include at least one projection formed on an overhung portion of the stem of each fastener, said belt straps being each formed with an additional stamp-out, the end of the respective belt strap being wound about the stem of the respective fastener and said one projection being engaged in the additional stamp-out.

12. The structure as defined in claim 10, wherein said fastening means further include a locking bar formed on the stem of each fastener and provided with two openings, said locking bar being pivotable with respect to said stem so that said projections are engaged in said two openings, respectively, and the end of the respective belt strap wound about the stem is clamped between the locking bar and the fastener.

* * * * *